US006590334B1

(12) United States Patent
Rasmussen et al.

(10) Patent No.: US 6,590,334 B1
(45) Date of Patent: Jul. 8, 2003

(54) FIELD EMISSION DISPLAYS HAVING REDUCED THRESHOLD AND OPERATING VOLTAGES AND METHODS OF PRODUCING THE SAME

(75) Inventors: Robert T. Rasmussen, Boise, ID (US); Surjit S. Chadha, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 08/599,436

(22) Filed: Jan. 18, 1996

(51) Int. Cl.[7] ..... H01J 29/28; H01J 1/70
(52) U.S. Cl. ..... 313/496; 313/466
(58) Field of Search ..... 313/495, 496, 313/497, 466, 470, 472, 336, 309, 351; 430/25

(56) References Cited

U.S. PATENT DOCUMENTS 4,233,623 A 11/1980 Pavliscak ..... 358/59
4,325,002 A * 4/1982 Kobale et al. ..... 313/472
4,891,110 A 1/1990 Libman et al. ..... 204/181.1
5,063,327 A * 11/1991 Brodie et al. ..... 313/495
5,378,962 A * 1/1995 Gray et al. ..... 313/495
5,378,963 A * 1/1995 Ikeda ..... 313/495
5,528,102 A * 6/1996 Gnade et al. ..... 313/496

OTHER PUBLICATIONS

Hiraki et al., "Properties of ZnO–Containing Phosphors Under Low Voltage Cathode Ray Excitation", Journal of Luminescence, 12/13 (1976) pp. 941–946.

Glaze Projects by R. Behrens; Ceramics Monthly Magazine Handbook pp 12 & 13 no date.*

* cited by examiner

*Primary Examiner*—Michael H. Day
(74) *Attorney, Agent, or Firm*—Hale and Dorr LLP

(57) ABSTRACT

The present invention is directed to anode screens of field emission displays wherein the phosphors on said anode are surrounded by a black or dark matrix which reduces the threshold and operating voltages of the display.

12 Claims, 4 Drawing Sheets

FIELD EMISSION DISPLAYS HAVING REDUCED THRESHOLD AND OPERATING VOLTAGES AND METHODS OF PRODUCING THE SAME

This invention was made with Government Support under Contract No. DABT63-93-C-0025 awarded by Advanced Research Projects Agency (ARPA). The Government has certain rights in this invention.

FIELD OF INVENTION

The invention is directed to field emission displays having reduced operating voltages and methods of producing the same. In addition, the invention is directed to field emission displays having reduced threshold voltages and methods of producing the same.

BACKGROUND OF THE INVENTION

Cathode ray tube (CRT) displays, such as those commonly used in desk-top computers screens, function as a result of a scanning electron beam from an electron gun, impinging on phosphors of a relatively distant screen. The electrons increase the energy level of dopant(s) in the phosphors. When the dopant(s) return to their normal energy level, they release energy from the electrons as photons of light, which is transmitted through the glass screen of the display to the viewer.

Field emission displays seek to combine cathodoluminescent-phosphor technology with integrated circuit technology to create thin, high resolution displays wherein each pixel is activated by its own electron emitter. Flat panel display technology is becoming increasingly important in appliances requiring lightweight portable screens. Currently, such screens use electroluminescent, liquid crystal, or plasma display technologies. A promising technology is the use of a matrix-addressable array of cold cathode emission devices or field emission devices ("FEDs") to excite pixels of phosphors on a screen. These devices are generally comprised of a baseplate and a faceplate. The faceplate has a cathodoluminescent phosphor coating that receives a patterned electron bombardment from an opposing baseplate thereby providing a light image which can be seen by a viewer. The faceplate is separated from the baseplate by a vacuum gap, and outside atmospheric pressure is prevented from collapsing the two plates together by physical standoffs between them, often referred to as spacers. Arrays of electron emission sites (emitters) are typically sharp cones that produce electron emission in the presence of an intense electric field. In the case of most field emission displays, a positive voltage is applied to an extraction grid relative to the sharp emitters to provide the intense electric field required for generating cold cathode electron emissions. Typically, FEDs are operated at anode voltages well below those of conventional CRTs.

The faceplate of a field emission display operates on the principle of cathodoluminescent emission of light. A color image can be obtained using a color sequential approach sometimes referred to as spatial integration. Nearly all commercially successful color displays today employ spatial integration to provide a color image to the viewer. A common way to employ spatial integration is to provide red, green, and blue pixels which are addressed in the form of R/G/B triads. The intensity of each of the color dots within the triad is adjusted relative to one another to produce a range of colors within the triangular boundary formed by the color coordinates of the R,G, and B dots as depicted on the 1931 or 1976 C.I.E. chromaticity diagram. The human eye is then relied upon for integrating the spatially separated R/G/B dots into a perceived color image.

Spatial color displays generally employ a black region separating the red, green, and blue patterned dots. A major advantage of the black region, referred to as the black matrix, is to improve the contrast of the display in ambient light. When a black matrix is employed on the faceplate it absorbs ambient incident light, thereby improving the contrast performance of the display. (See, e.g., U.S. Pat. Nos. 4,233,623 and 4,891,110 both incorporated herein by reference.)

As stated above, in field emission displays, electrons are emitted toward the phosphor coated screen. A phosphor is generally a substance, either organic or inorganic, liquid or crystalline, that is capable of luminescencing, i.e., of absorbing energy from sources such as x-rays, cathode rays, ultraviolet radiations, alpha particles and emitting a portion of energy in the ultraviolet, visible or infrared. Examples of such phosphors include: oxides, halides, silicates, borates, sulfides, titanates, phosphates, halophosphates, tungstates, germanates, stannates, indates, aluminates, gallates, arsenates, germinates, vanadates of zinc, silver, cadmium, indium, zirconium, germanium, tin, lead, strontium, titanium, lithium, sodium, potassium, thallium, gallium, magnesium, strontium, calcium, barium, thorium, scandium, yttrium, vanadium, and the Lanthanide Series rare earth metals. It should be noted, as known to one of ordinary skill in the art, not all of the metal ions listed above will form compounds with all of the listed anionic groups and in some cases not all of the formed compounds will be useful as lattices for phosphor preparation. However, all phosphors are not recommended for use in FEDs because the cathodes are in very close proximity to the faceplate and are sensitive to any electronegative chemicals arriving on the cold cathode emitter surfaces which could absorb and increase the value of the work function. Consequently, sulfides of cadmium or zinc are not recommended for use in FEDs. Particularly preferred phosphors for use in FEDs include ZnO:Zn, $Y_3(Al,Ga)_5O_{12}$:Tb, $Y_2SiO_5$:Ce, $Y_2O_3$:Eu, $Zn_2SiO_4$:Mn, $ZnGa_2O_4$:Mn. These phosphors tend to be dielectric in nature (except for, e.g., ZnO:Zn and $ZnGa_2O_4$) and consequently, the threshold voltages (the voltage necessary to excite the phosphor) tend to be high. For example, generally the threshold voltages for phosphors utilized in FEDs tend to range from about 500 volts to about 2000 volts. Generally, the threshold voltage of phosphors in vacuum, fluorescent displays has been lowered by adding conducting materials to the phosphors before application to the screen, such as non-luminescent zinc oxide or indium tin oxide powders. (See, e.g., "Properties of ZnO-Containing Phosphors Under Low Voltage Cathode Ray Excitation," H. Hiraki, A. Kagami, T. Hase, K. Narita, and Y. Mimura, Journal of Luminescence, 12/13 (1976) p. 941–946 which is incorporated herein by reference). It has been found that in operation, a charge builds up on the phosphors which are not conductive or semi-conductive. The incident electrons on the phosphors surface are reflected, scattered, or absorbed by the phosphor. Furthermore, if the energy of these incident electrons is greater than a few tens of eV, then they can create a large number of secondary electrons within the phosphor screen. Some of these secondary electrons can escape back into the vacuum provided they have sufficient energy to overcome the work function of the phosphor surface. This can lead to the floating surface of the phosphor to shift its potential when the number of incident electrons is not equal to the number of secondary electrons escaping from the surface. The negative charge built up on the phosphor screen, by reducing its potential, seriously diminishes the light output, leading to an unstable emission.

Due to the fact that field emission displays will become important in portable appliances which rely on portable power sources, there is a need to reduce the threshold and operating voltages of such devices. This reduction in voltage is also important because of the small distance between the emitter and the faceplate which can lead to arcs, if the voltage is too high. The present invention provides field emission displays with reduced threshold voltages and thereby lower operating voltages. In addition, the present invention provides a method of manufacturing displays with reduced threshold voltages and operating voltages.

SUMMARY OF THE INVENTION

The invention is directed to a field emission display comprising: (1) a baseplate comprising an electron emitter cathode, and (2) a faceplate anode having phosphors and a matrix coated thereon, wherein said matrix lowers the threshold voltage of the display.

The invention is also directed to a reduced operating voltage field emission display comprising: (1) a baseplate comprising an electron emitter, and (2) a faceplate comprising a screen, phosphors on said screen, and a matrix comprising conductive or metallic particles around said phosphors.

The present invention is further directed to a field emission display comprising: (1) a baseplate for emitting electrons, and (2) a faceplate screen having phosphors thereon, said phosphors surrounded by a black matrix wherein said matrix reduces the threshold voltage of the display and thereby also reduces the operating voltage.

In addition, the present invention is directed to a process for making a field emission display screen having a faceplate substrate comprising: (1) coating the substrate with a conductive layer; (2) coating the substrate with photoresist; (3) patterning the photoresist; (4) depositing a matrix comprised of conductive or metallic particles on the substrate; and (5) removing the photoresist.

BRIEF DESCRIPTION OF THE DRAWINGS

The present invention will be better understood by reading the following description of nonlimitative embodiments, with reference to the attached drawings, wherein like parts in each of the several figures are identified by the same reference character, and which are briefly described as follows.

It should be emphasized that the drawings of the instant application are not to scale but are merely schematic representations and are not intended to portray specific parameters or the structural details of a field emission display which are well known in the art.

DETAILED DESCRIPTION OF THE INVENTION

Figure 1:
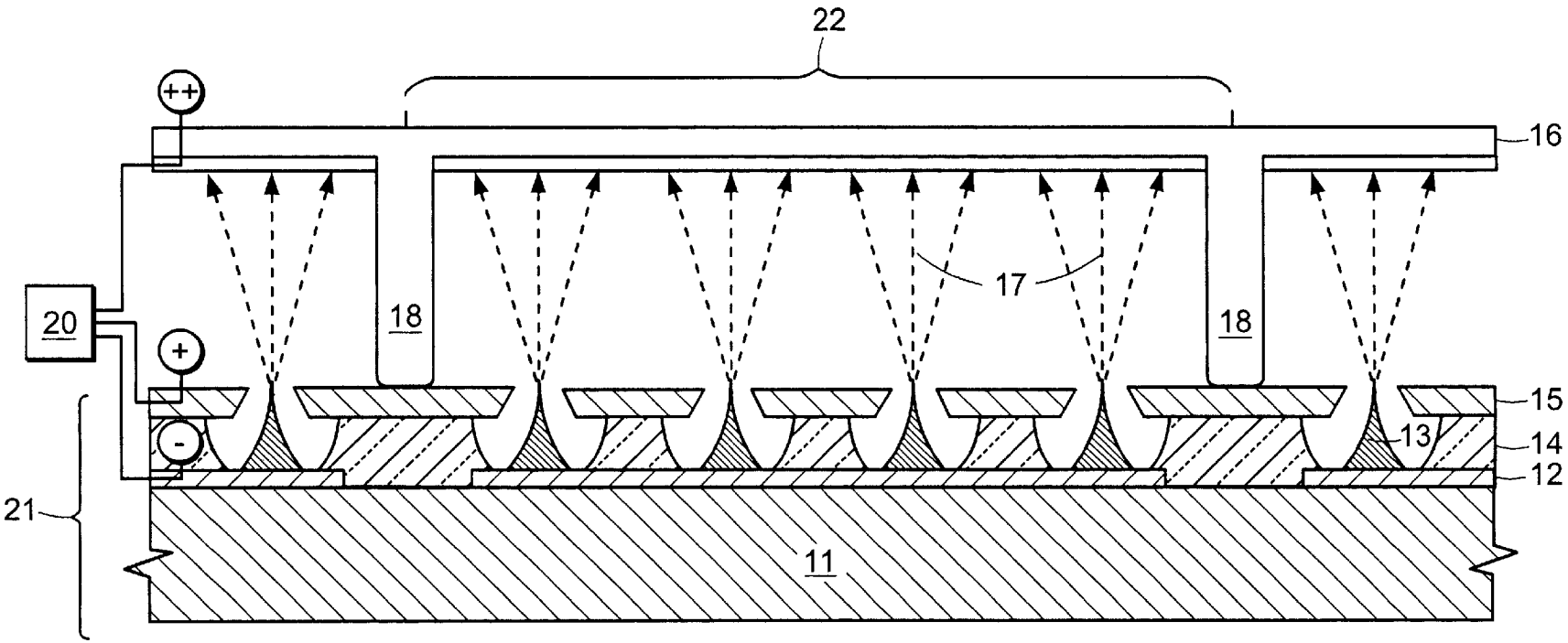
FIG. 1 PRIOR ART
FIG. 1 is a cross-sectional schematic drawing of a pixel of a field emission display consisting of a faceplate with a phosphor screen vacuum sealed to a baseplate which is supported by spacers.

Referring to FIG. 1, a field emission display employing a cold cathode 21 is depicted. The substrate 11 can be comprised of glass or amorphous silicon, for example, or any of a variety of suitable materials including molybdenum, tungsten, or amorphic diamond, etc. In the preferred embodiment, a single crystal silicon layer serves as substrate 11 onto which a conductive material layer 12, such as doped polycrystalline silicon, has been deposited. At a field emission site location, a conical micro-cathode 13 (also referred to herein as an emitter tip) has been constructed on top of substrate 11. Surrounding the micro-cathode 13, is a low potential gate structure 15. When a voltage differential, through source 20, is applied between cathode 13 and gate 15, an electron stream 17 is emitted toward a phosphor coated screen 16. The screen 16 functions as an anode. The electron emission tip is integral with the single crystal semiconductor substrate 11, and serves as a cathode conductor. A dielectric insulating layer 14 is deposited on the conductive cathode layer 12. The insulator 14 also has an opening at the field emission site location spacers 18 extend from screen 16 to gate 15 of cathode 21.

Figure 2:
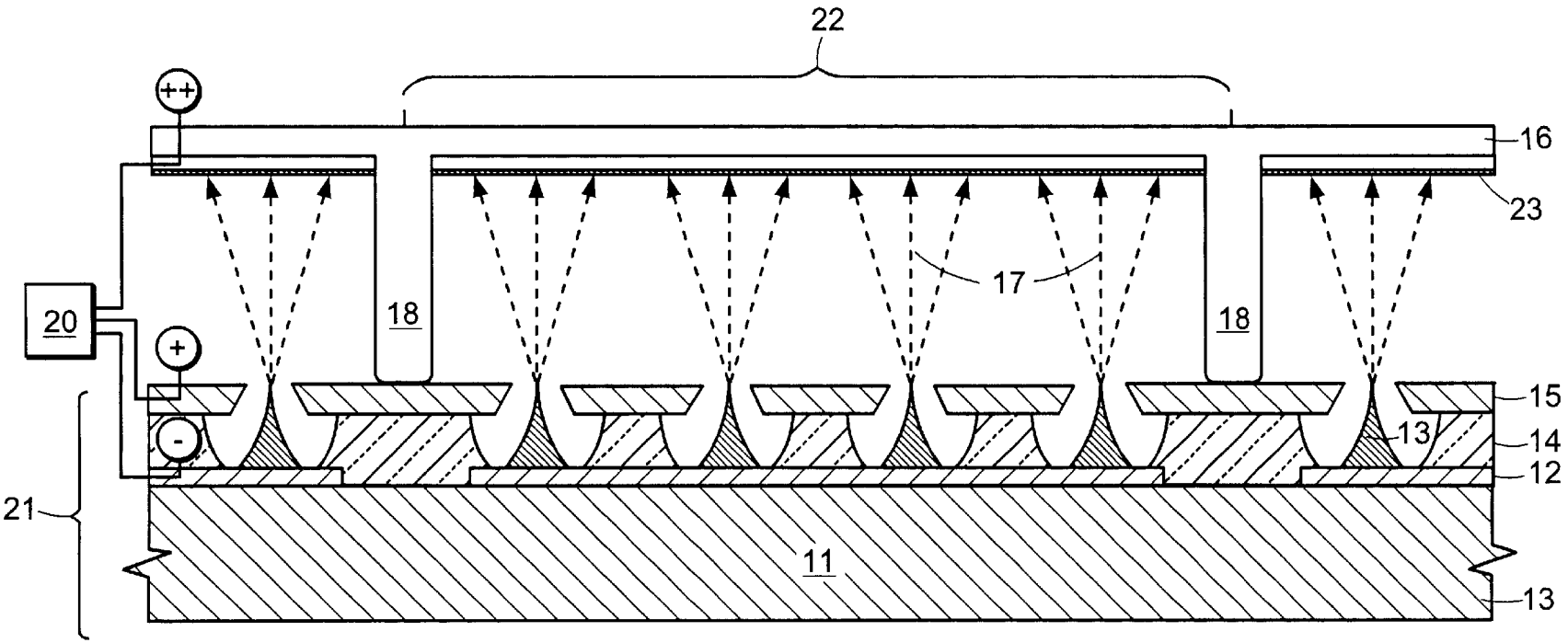
FIG. 2 is a cross-sectional schematic drawing of a pixel of a field emission display consisting of a faceplate with a phosphor screen illustrating the position of matrix 23 of the present invention, vacuum sealed to a baseplate which is supported by spacers.

In FIG. 2, a field emission device is depicted like that depicted in FIG. 1 illustrating the placement of matrix 23 of the present invention.

Figure 4:
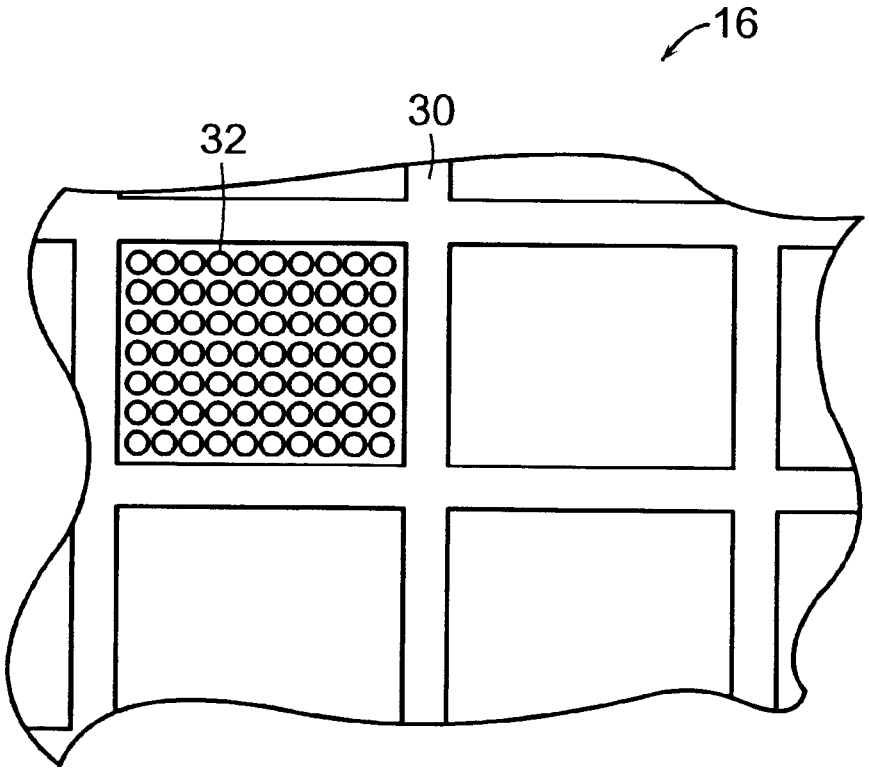
FIG. 4 is a plan view showing an anode with a matrix around phosphors.

Referring also to FIG. 4, the present inventive matrix 30 around the phosphors 32 on screen 16 (phosphors 32 are only shown in one region delimited by matrix 30) reduces the threshold voltages and thus, operating voltages of displays. According to one embodiment of the invention, the matrix of the present invention is comprised of conductive and/or metallic particles. The black or dark matrix of the present invention can also be comprised of a thick or thin film as well. The conductive particles of the matrix of the present invention, according to one embodiment, are selected from the group consisting of diaqueous graphite, manganese dioxide, $PrMnO_3$, chromium dioxide, iron oxide, and conductive powder silicon. It should also be noted that where oxides are involved, these oxides are preferably the sub-stoichiometric forms which are conductive or semi-conductive. In addition, other black or dark materials may be used in the practice of the invention and include materials which are not conductive by themselves, but which are conductive when added to materials such as indium oxide, tin oxide, zinc oxide, niobium oxide, titanium oxide, etc. For example, particles useful in the matrix of the present invention include, according to one embodiment, particles selected from the group consisting of chromium, yttrium, rhenium, molybdenum, and boron.

The preferred composition of the black matrix of the present invention is comprised of $PrMnO_3$ in powder form deposited by electrophoresis or sputter coated in thin film form. Preferably, the matrix of the present invention is comprised of from about 5% binder and about 95% $PrMnO_3$ when deposited by eletrophoresis. The preferred binder is GR 650, nitrocellulose, ethyl cellulose, colloidal silica.

The matrices of the present invention may be applied to the faceplate substrate utilizing techniques known in the art, e.g., electrophoresis, thin film techniques or chemical means. (See, for example, U.S. Pat. No. 4,891,110 which is incorporated herein by reference.) The matrices of the present invention may be applied as a layer over, e.g., a black matrix used to enhance the contrast of the screen. In addition, conducting or metallic particles may be added to a black matrix and applied as a single layer around the phosphors, resulting in not only contrast enhancement but the reduction of threshold voltages and thus, operating voltages. Preferably, the matrix of the present invention lowers the threshold voltage of the display below about 300 volts and the operating voltage below about 500 volts.

Figure 3:
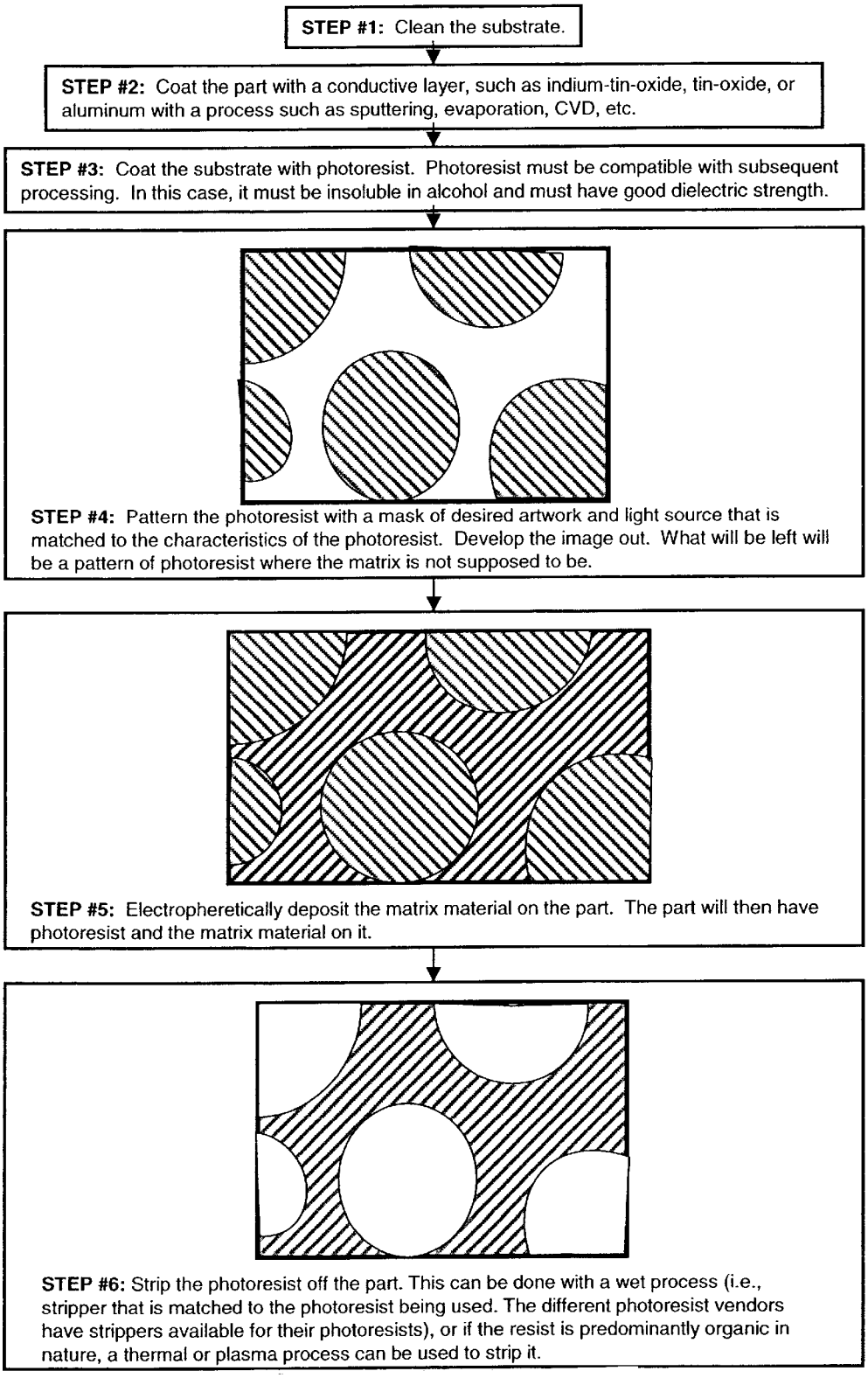
FIG. 3 is a process flow for formation of conductive grill by electrophoretic deposition process.

Referring to FIG. 3, the preferred process steps involved in the formation of an anode screen for a field emission device of the present invention having reduced operating and threshold voltages are as follows: (1) clean the substrate; (2) coat the substrate with a conductive layer, such as indium-tin-oxide, tin-oxide, or aluminum with a process such as sputtering, evaporation, CVD, etc.; (3) coat the substrate with photoresist wherein the photoresist is compatible with subsequent processes, for example, it should be insoluble in alcohol and should have good dielectric strength; (4) pattern the photoresist with a mask of desired artwork and light source that is matched to the characteristics of the photoresist and develop the image (what will be left is a pattern of photoresist where the matrix is not supposed to be); (5) electrophoretically deposit the matrix material on the substrate (the substrate will then have photoresist and the matrix material on it); and (6) strip the photoresist off the substrate which can be done with a wet process (i.e., a stripper that is matched to the photoresist being used which is available from different photoresist vendors for each photoresist) or if the resist is predominately organic in nature, a thermal or plasma process can be used to strip it.

The matrix of the present invention can be made by thin film techniques including thermal evaporation, CVD, sputtering, chemical deposition, electron beam evaporating, laser ablation, sol-gel, or other techniques known to those skilled in the art. In addition, the matrix of the present invention can be made by thick film techniques including but not limited to photolithographic techniques, electrophoresis, doctor blading, printing, spraying, etc. Depending upon the technique utilized, the thick or thin film can be patterned, before, during or after the deposition process.

For example, a typical electrophoresis may include photolithographic steps as well. Such a process includes cleaning the substrate, applying a resist, exposing, and developing. The electrophoretic bath may contain about 0.01% by weight matrix material, 0.105% by weight lanthanum nitrate (hydrated), and approximately 99.975% by weight isopropyl alcohol. It should be noted that other ingredients could be added and this example is not meant to be limiting. The resist can be an OCG SC series resist, or a polyimide resist. A coating is applied electrophoretically and the resist is removed by washing in, for example; OCG Microstrip. If needed, a binder is added and, if necessary, the material is baked to harden. Acceptable binders include GR 650F manufactured by Techniglass, Inc., and 2040NH4 manufactured by Nyacol Inc. While the invention is acceptable to various modifications in alternate forms, specific embodiments have been shown by way of example and have been described in detail herein. However, it should be understood that the invention is not intended to be limited to particular embodiments disclosed. Rather, the invention is to cover all modifications, equivalents and alternatives falling within the spirit and the scope of the invention as defined by the appended claims.

We claim:

1. A field emission display comprising:

a cathode having a number of emitters for emitting electrons, and a faceplate screen having:

a substrate, a conductive layer formed over the substrate, phosphors formed on the conductive layer, and a black matrix formed on the conductive layer and defining areas of phosphor on the screen, the black matrix formed including conductive particles.

2. The field emission display of claim 1 wherein said particles are selected from the group consisting of graphite, $PrMnO_3$, $Fe_2O_3$, and $MnO_2$ in a substoichiometric form.

3. The field emission display of claim 1 wherein said particles are selected from the group consisting of chromium, yttrium, rhenium, molybdenum, and boron.

4. The display of claim 1 wherein the threshold voltage of the display is below about 300 volts.

5. The display of claim 1 wherein the black matrix consists of metallic particles and a binder.

6. The display of claim 1 wherein the conductive particles in the black matrix reduces the operating voltage of the display relative to what the operating voltage would be without the conductive particles in the matrix.

7. The display of claim 1 wherein the operating voltage is below about 500 volts.

8. A display device comprising:

a transparent substrate;

a conductive layer over the substrate;

an opaque matrix over the conductive layer, the matrix consisting essentially of conductive particles and a binder, the matrix defining a number of regions; and luminescent material in the regions defined by the matrix.

9. The device of claim 2, wherein the conductive particles are $PrMnO_3$ in a substoichiometric form.

10. The display device of claim 8, wherein the matrix is about 95% conductive particles and 5% binder.

11. The device of claim 10, wherein the conductive particles are $PrMnO_3$ in a substoichiometric form.

12. The display device of claim 8, wherein the display device is a field emission display device, the device further comprising a cathode having a plurality of individual electron emitters.

* * * * *